US005809824A

United States Patent [19]

Hiltzman

[11] Patent Number: 5,809,824

[45] Date of Patent: Sep. 22, 1998

[54] WIRE BENDER

[76] Inventor: Jerry R. Hiltzman, P.O. Box 1093, Cushing, Okla. 74023

[21] Appl. No.: 869,334

[22] Filed: Jun. 5, 1997

[51] Int. Cl.[6] ..... B21F 1/06

[52] U.S. Cl. ..... 72/387; 140/102.5; 140/104

[58] Field of Search ..... 72/387, 388; 140/102.5, 140/104, 105, 123

[56] References Cited

U.S. PATENT DOCUMENTS

| | | | |
|---|---|---|---|
| 1,261,550 | 4/1918 | Kilmer | 140/104 |
| 1,316,257 | 9/1919 | Snell | 140/104 |
| 1,463,870 | 8/1923 | Campbell | 140/102.5 |
| 3,688,434 | 9/1972 | Le Vau . | |
| 3,786,841 | 1/1974 | Albrecht et al. . | |
| 3,828,538 | 8/1974 | Yoshida et al. . | |
| 4,380,883 | 4/1983 | Greaux . | |
| 4,423,757 | 1/1984 | Broberg, Jr. . | |
| 4,468,880 | 9/1984 | Olszewski . | |
| 4,776,159 | 10/1988 | Lu . | |
| 5,271,260 | 12/1993 | Oetlinger | 72/387 |
| 5,297,593 | 3/1994 | Holzman . | |

*Primary Examiner*—David Jones
*Attorney, Agent, or Firm*—Chase & Yakimo

[57] ABSTRACT

A tool for producing a loop in a straight wire includes a base having a vertical wall extending therefrom. A shaft extends from the wall and has a crank rotatably mounted thereto. Indicia on the wall measure the degrees of a circle about the shaft. A linear groove radially extends from the shaft and to the 12 o'clock position. Upon placement of a first portion of a straight wire in the linear groove, the remaining second wire portion extends out of the linear groove and towards the six o'clock position. The length of this extension is measured by indicia on the wall. Upon placement of a crank on the shaft a post on the shank seats into a circular groove about the shaft. Rotation of the crank about the shaft causes the post to contact the second wire portion and bend the wire about the shaft to form a loop. Indicia in the form of the degrees of the circle enable the user to measure the degree of crank rotation so that consistent wire loops may be subsequently formed. A stop post can be releasably insertable in the wall face to preclude rotation of the crank beyond a desired position.

19 Claims, 7 Drawing Sheets

WIRE BENDER

BACKGROUND OF THE INVENTION

This invention relates to a wire bender and, more particularly, to a device for forming a wire loop of a consistent dimension and configuration from a portion of straight wire.

Various devices have been proposed to form loops from a straight length of wire, such as for use in fishing components or the like. Such devices have ranged from the use of needle nose pliers to relatively complex apparatus. Sometimes it is desirable to form a plurality of wire loops having a consistent configuration. Although various devices have been proposed to form such loops, such devices have not provided for the consistent formation of a wire structure having a consistent loop configuration.

Accordingly, it is desirable to have a tool for consistently forming a wire loop structure having first and second straight wire ends with an intermediate loop therebetween, the configuration of the loop as well as the angular relationship between the straight wire ends being easily adjustable and reproducible by the user.

In response thereto I provide a tool device mounted to a horizontal table or a vertical wall surface that utilizes a base having an upstanding wall face with a post at the center thereof. One end of a straight wire fits into a groove which radially extends from the center post and towards a top of a dial face. The other end of the wire extends from the grove and towards the dial face. A crank is rotatably attached to the center post and has a post extending toward the dial face. Upon rotation of the crank about the center post, the post first contacts the extension of the wire adjacent the dial face and then urges the wire about the fixed center post and into a loop configuration. A plurality of circle degree indicia are positioned about the dial face so as to indicate the degree of rotation of the crank corresponding to the resulting amount of bending of the wire about the center post and/or the angular relationship of the straight ends of the wire upon loop formation. A stop post can be releasably extended from the dial face so as to preclude movement of the crank beyond the stop post and thus the amount of bending of the wire about the center post. The device allows for a plurality of wire loops to be formed, each having a consistent loop configuration and straight wire end relationship.

DESCRIPTION OF THE PREFERRED EMBODIMENT

Figure 1:
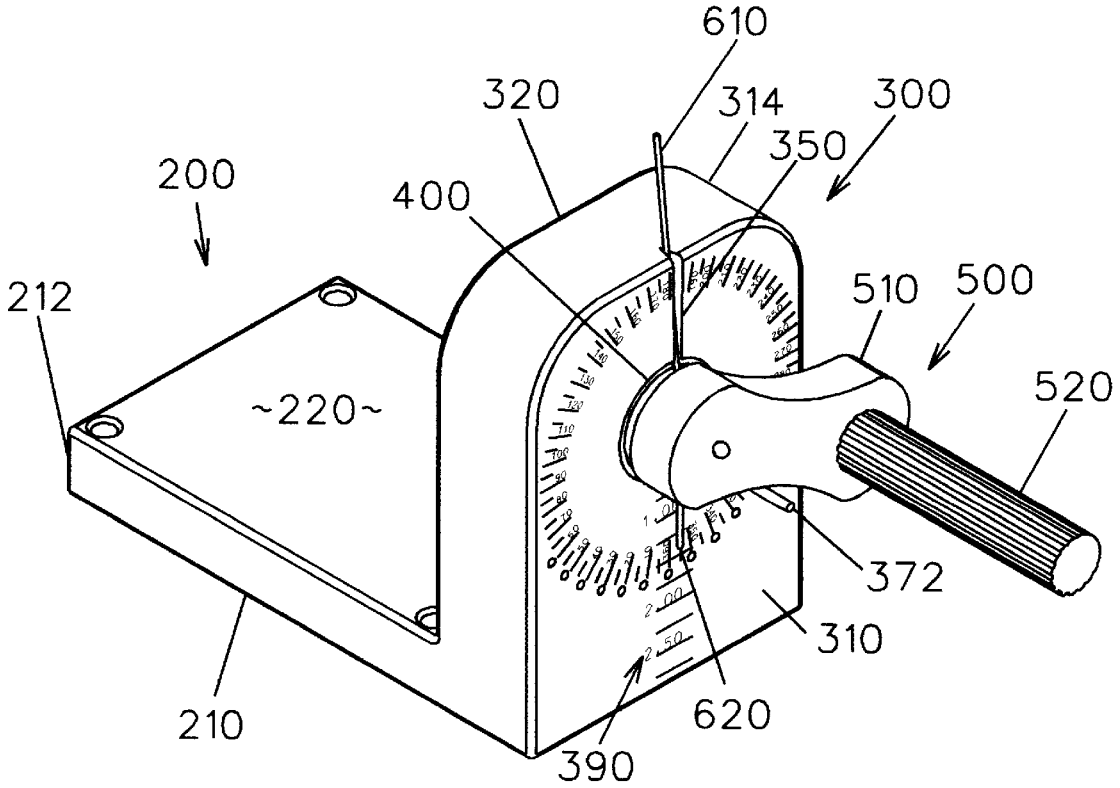
FIG. 1 is a perspective view of the wire bender device.
Figure 2:
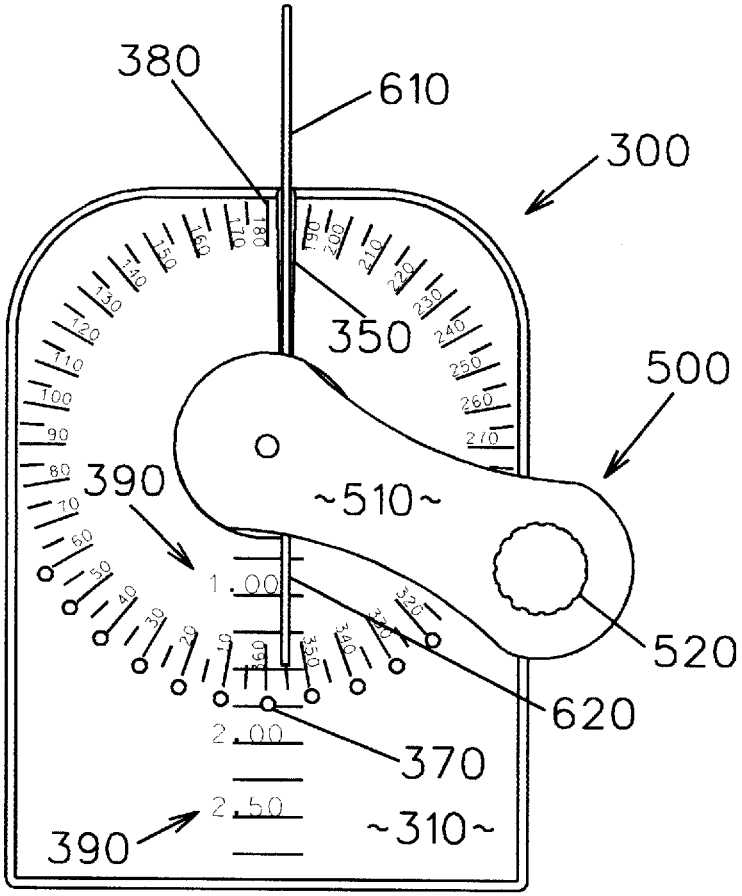
FIG. 2 is a front view of the device of FIG. 1.
Figure 3:
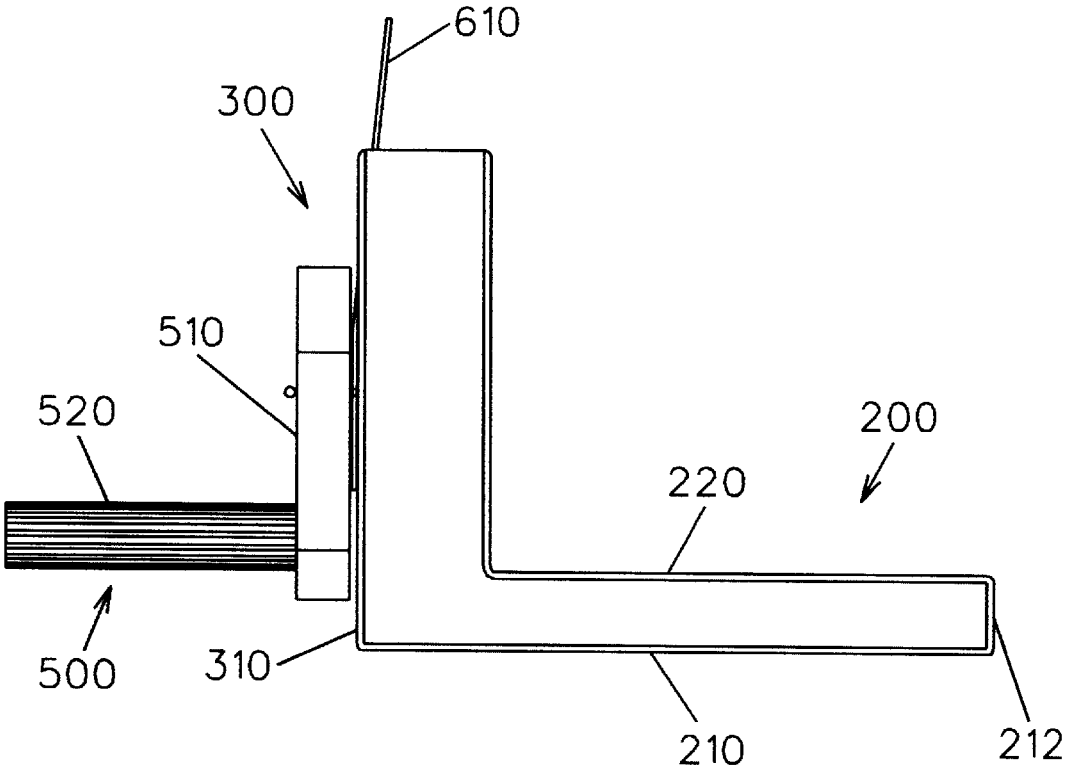
FIG. 3 is a right side view of the device of FIG. 1.
Figure 4:
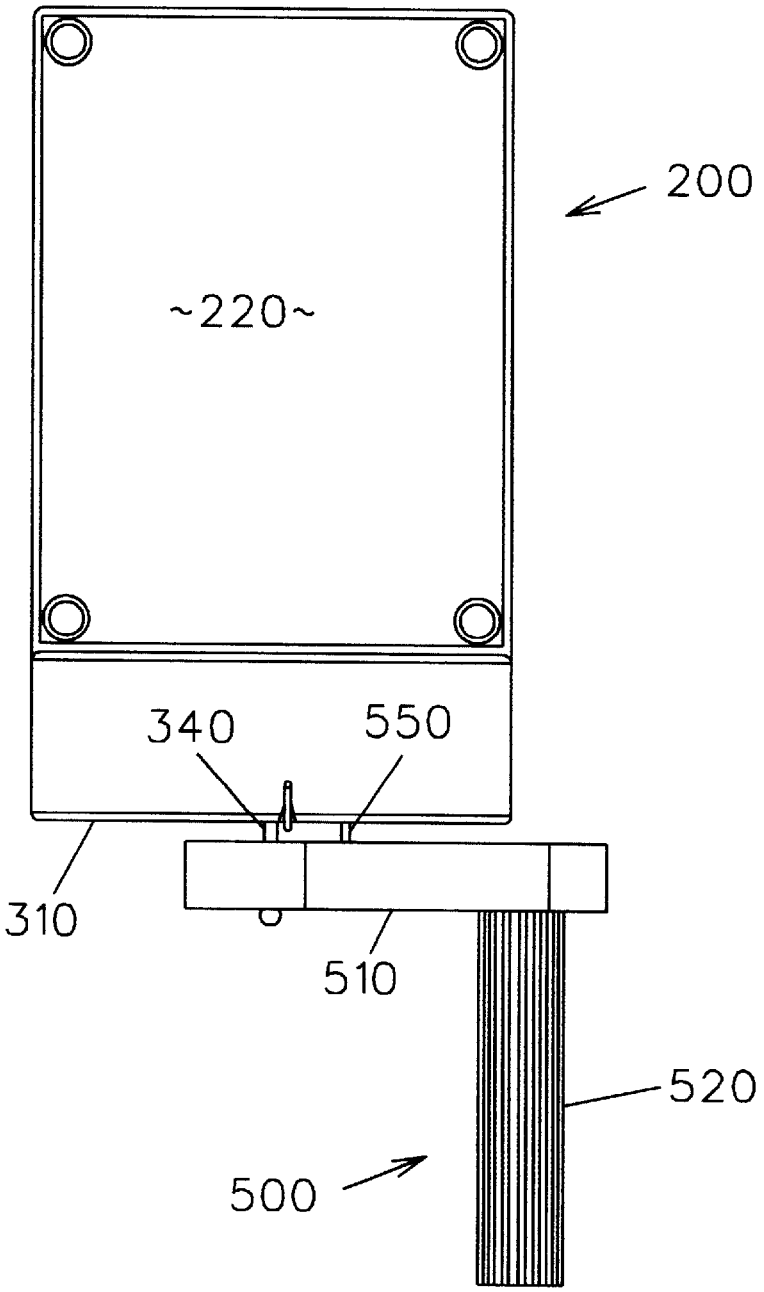
FIG. 4 is a top view of the device of FIG. 1.
Figure 5:
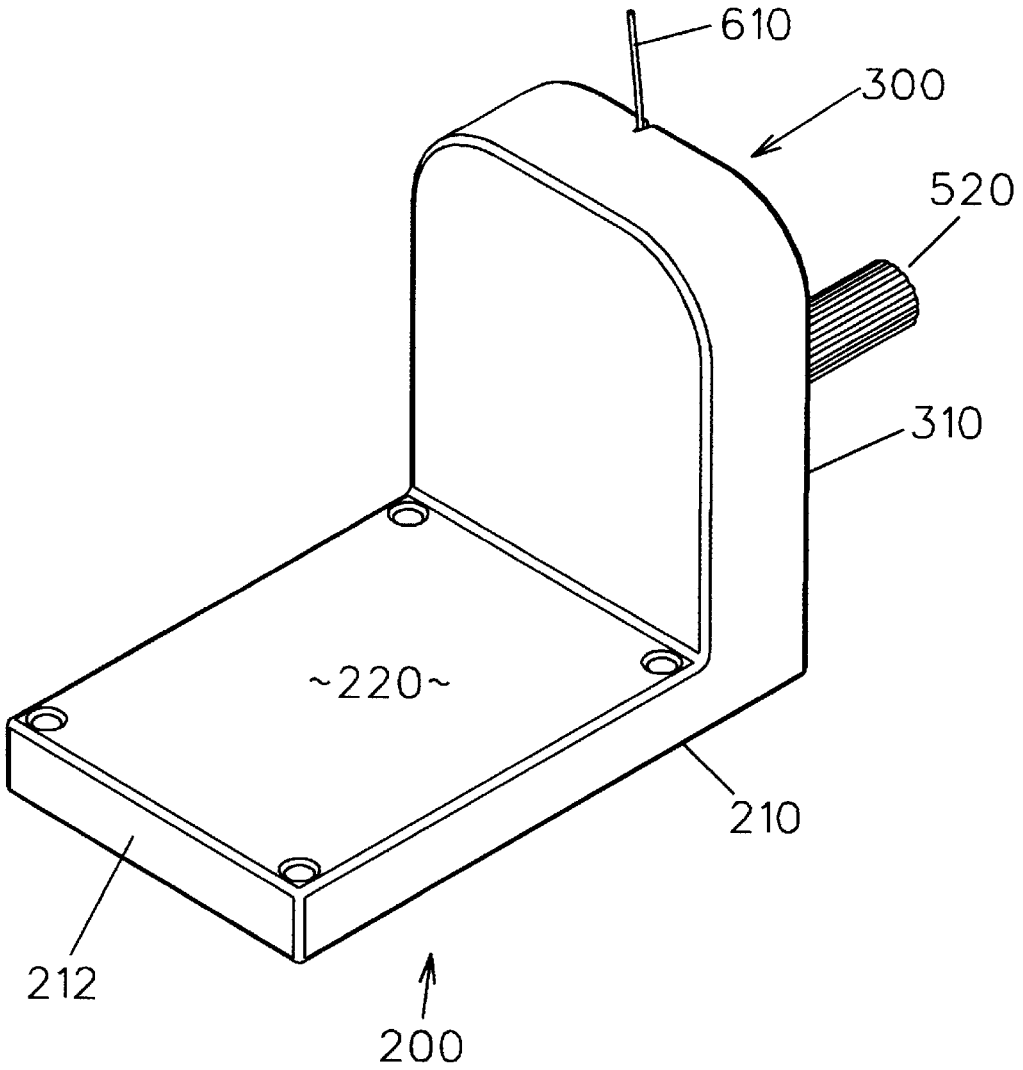
FIG. 5 is a rear perspective view of the device of FIG. 1.
Figure 6:
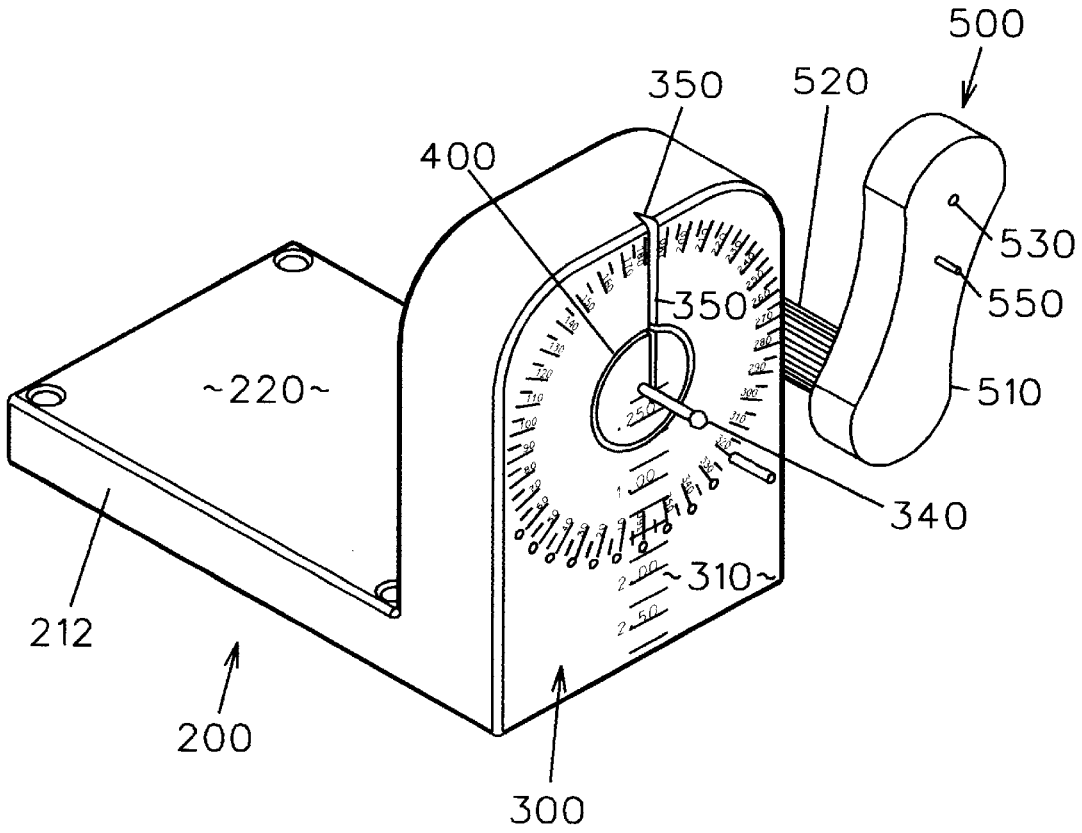
FIG. 6 is a perspective view of the device of FIG. 1 with the handle removed therefrom.

Turning more particularly to the drawings, FIG. 1 shows the wire bender 100 as comprising a base 200, an upstanding dial face assembly 300 and a crank assembly 500.

The base 200 includes a bottom wall 210, a top wall 220 with a vertical wall 212 extending therebetween. Upstanding from one end of base 200 is the dial assembly 300, including a front face 310, rear wall 320 and intermediate wall 314.

On the front face/wall 310 of dial 300 is positioned a center post 340 having a groove 350 radially and upwardly extending therefrom. The center post 340 is aligned with a centerpoint of an imaginary first circular path extending about the center post 340. The 360° of this circular path are indicated in degrees by degree indicia beginning at the six o'clock position 370, a 180° indicia at the twelve o'clock position 380 and a 360° indicia at the same six o'clock position 370. Intermediate indicia at 10° intervals also appear about the dial face 310.

A circular groove 400 having the center post 340 as the centerpoint thereof is presented in face 310 for a purpose to be subsequently described.

The center post 340 further functions as a shaft for attachment of the crank 510 of crank assembly 500 thereto. The crank assembly 500 includes a crank 510 with handle 520 normally extending therefrom. Located within crank 510 is an aperture 530 for a releasable snap fit engagement to the center post 340. Also extending from the crank 510 is a post 550. Upon attachment of the crank 510 to the center post 340 the end of post 550 seats within the circular groove 400.

Upon removal of the crank assembly 500 from center post 340, one end portion 610 of a straight piece of wire 600 is inserted in the vertical groove 350 with the other end portion 620 of the wire extending from the groove 350 past center post 340 and towards the six o'clock/0° position. The linear amount of extension of the wire end 620 beyond the center post 340 can be measured by the indicia 390 extending below the center post 340 and towards the 0°/360° or six o'clock position 370. A portion of wire end 610 can extend above the dial face 310 for grasping by the user.

Upon mounting the crank assembly 500 to the center post 340, post 550 will seat within groove 400 but will overlie the portion of the first wire end 610 within groove 350 and traverse the circular groove 400. Upon clockwise rotation of the crank 510 about center post 540 by manipulation of handle 520, post 550 will contact the portion 620 of the wire end without the groove 350 which extends beyond the center post 340 and along the dial face 310.

Figure 8:
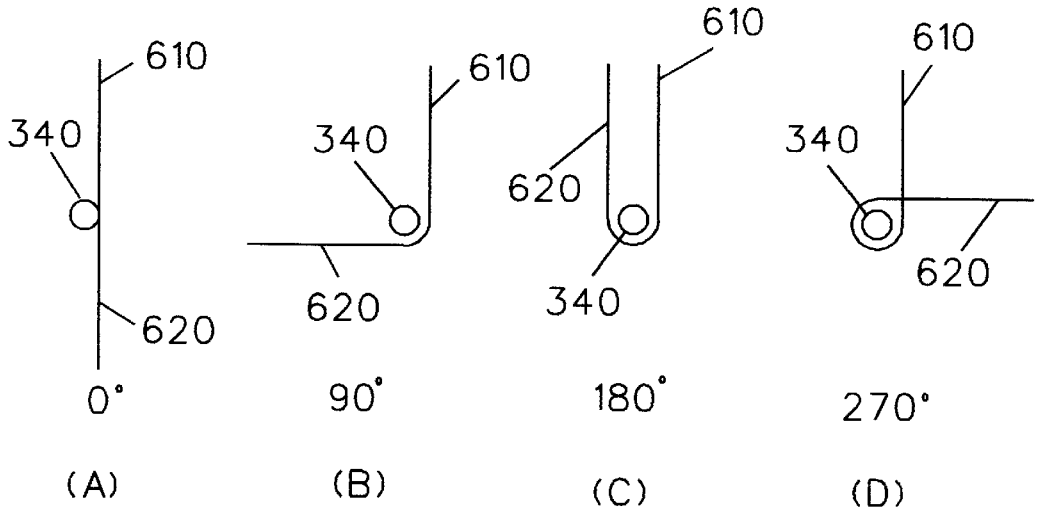
FIG. 8 is a diagrammatic view of a straight wire showing the relationship of the wire ends during movement of the crank among 0°, 90°, 180° and 270° positions.

The degree of the bend between the upper 610 and lower 620 straight wire portions can be controlled by observation of the degree indicia on the dial face 310 which indicates the degree of rotation of the crank 510 between a first zero degree position at which wire contact is initiated and a second final position at which rotation of crank 510 and the bending of the wire ceases. Thus, the post 550 upon crank 510 rotation in a clockwise direction first contacts wire portion 620 at the zero degree position (FIG. 10*a*). Upon further crank 510/post 550 movement the wire ends 610, 620 will form a 90° relationship (FIG. 10*b*), a parallel relationship (FIG. 10*c*), and a 270° relationship as shown (FIG. 10*d*) assuming 270° is the final position of rotation of crank 510. As shown in FIG. 8, the wire end 620 has been displaced around the center post 340 during crank rotation, the degree of crank rotation from the 0°/six o'clock position being on the dial face 310. Upon forming the desired loop/wire end configuration, the crank assembly 500 is removed from the center post 340 so that the formed wire loop structure can be removed. Upon subsequent placement of a straight wire within the groove 350, a new identical wire loop structure can be formed in a manner as above described.

The degree indicia about the dial face 310 enables the user to form a plurality of wire loop structures having a similar loop and angular relationship between the straight wire ends as above described. The indicia 390 below center post 340 assures the user that the extension of the wire beyond the center post and subsequently formed loop is of a consistent length.

To assure that a consistent configuration is subsequently formed, a stop post 372 may be inserted in one of the circular apertures 370 adjacent one of the circular degree indicia after clockwise rotation of the crank 510 past the 90° position. Such a position will correspond to the desired final position of the crank 510. Thus, subsequent contact of the crank 510 with the stop post 372 will preclude further rotation of crank 510 beyond this desired final position. Accordingly, the stop post 372 controls rotation of the crank 510 so as to form a similarly configured wire loop structure upon each subsequent operation.

As can be appreciated, the above device 100 enables a simple, quick and efficient formation of a straight wire into a wire loop structure. Moreover, device 100 offers assurance that subsequent wire loop structures will be similar to those previously formed, if so desired.

Figure 7:
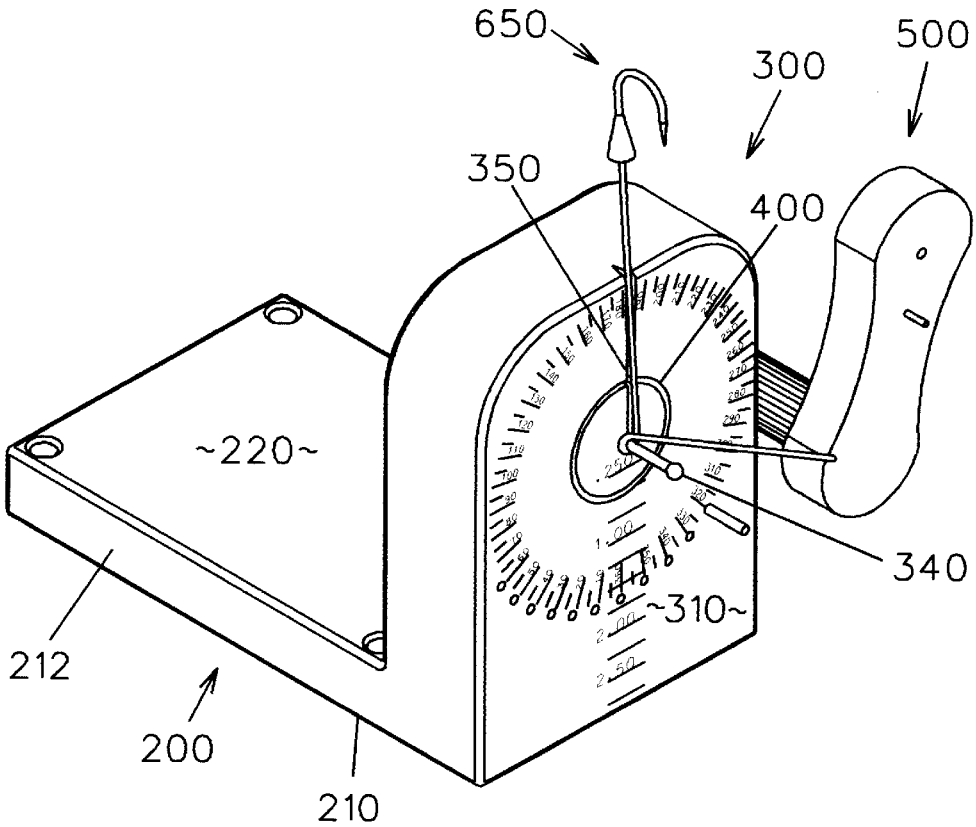
FIG. 7 is a perspective view of the device of FIG. 6 showing a use of the wire loop bender in a fishing application.

One application of the tool 100 is shown in FIG. 7 in which the fishing hook end of a straight wire portion is inserted into groove 350 with the remaining end extending without groove 350. Accordingly, this remaining end can be bent about center post 340 as above described.

It is to be understood that while a certain form of this invention has been illustrated and described, it is not limited thereto except insofar as such limitations are included in the following claims and allowable functional equivalents thereof.

Having thus described the invention, what is claimed as new and desired to be secured by Letters Patent is as follows:

1. A device for producing a loop between first and second ends of a straight wire comprising:

a base;

a wall upstanding from said base;

a shaft extending from said wall;

a crank rotatably attached to said shaft;

a post extending from said crank and having an end adjacent said wall upon said attachment of said crank to said shaft;

a groove in said wall and radially extending from said shaft, said groove adapted to receive a portion of a first end of a wire therein below a surface of the wall with a second end of the wire extending at a first position from said groove, beyond said shaft and atop said surface, a rotation of said crank about said shaft urging said post into contact with said second wire end at a first position and a bending of said second end about said shaft during crank rotation to a second position, said bending producing a loop in said wire during said crank rotation between said first and second positions.

2. The device as claimed in claim 1 further comprising:

a circular groove in said wall about said shaft, said post end seated in said groove.

3. The device as claimed in claim 1 further comprising indicia on said wall indicative of a length of said second wire end extending from said groove and beyond said shaft.

4. The device as claimed in claim 1 further comprising a plurality of indicia positioned about said shaft, said indicia indicative of a degree of rotation of said crank about said shaft between said first position contacting said second wire end and said second position.

5. The device as claimed in claim 4 further comprising a stop post releasably insertable in said wall corresponding to said second position of said crank and said post, said stop post contacting said crank to preclude further rotation of said crank beyond said second position.

6. The device as claimed in claim 1 further comprising at least one aperture in said base for receiving a corresponding fastener therethrough, said fastener attaching said base to a desired support surface.

7. A device for producing a loop in a wire comprising:

a base;

a wall extending from said base;

a shaft normally extending from said wall and forming a centerpoint for an imaginary circle on said wall;

a crank attached to said shaft;

a post extending from said crank and having a free end;

a circular groove in said wall, said shaft defining a centerpoint of said circular groove, said circular groove adapted to receive said post free end therein upon attachment of said crank to said shaft;

a linear groove in said wall and radially extending from said shaft and traversing said circular groove, said linear groove adapted to receive a first straight portion of a wire therein below a surface of the wall with a second straight portion of the wire radially extending from said linear groove and shaft along said wall, a rotation of said crank about said shaft urging said post through said circular groove and into contact with said second wire portion radially extending from said groove, said contact bending said second wire portion about said shaft during a further rotation of said crank whereby to form a loop in said wire.

8. The device as claimed in claim 7 further comprising means on said wall for measuring a length of said second wire portion extending from said groove.

9. The device as claimed in claim 7 further comprising means on said wall for measuring a degree of rotation of said crank from a first crank position wherein said post contacts said second wire portion to a second crank position corresponding to a formation of said loop.

10. The device as claimed in claim 9 further comprising means releasably protruding from said wall for precluding rotation of said crank beyond said second position.

11. The device as claimed in claim 7 wherein said crank is releasably attached to said shaft.

12. A device for producing a loop in a wire comprising:

a dial face;

a crank;

means for rotatably mounting said crank to said dial face;

a linear groove in said dial face, said groove adapted to receive a first extent of a wire therein below a surface of the face with a second extent of the wire extending from said groove and along said surface of said face;

means on said crank for engaging said second wire extent upon said crank rotation, said engaging means urging said wire about said mounting means whereby to produce a loop in said wire during said crank rotation.

13. The device as claimed in claim 12 wherein said engaging means comprises a lug extending from said crank.

14. The device as claimed in claim 13 further comprising a circular groove in said dial face, said lug seated in said circular groove.

15. The device as claimed in claim 12 further comprising indicia on said dial face indicative of a degree of rotation of said crank between a first and a second position.

16. The device as claimed in claim 12 further comprising indicia on said dial face indicative of a length of said second wire extent.

17. The device as claimed in claim 12 wherein said rotatable mounting means comprises a shaft extending from said dial face, said crank having a bore for receiving said shaft therein.

18. The device as claimed in claim 17 wherein said shaft is positioned at a first end of said linear groove.

19. The device as claimed in claim 12 further comprising means extending from said dial face for precluding movement of said crank beyond a desired position on said dial face.

* * * * *

UNITED STATES PATENT AND TRADEMARK OFFICE

CERTIFICATE OF CORRECTION

PATENT NO. : 5,809,824

DATED : September 22, 1998

INVENTOR(S) : Jerry R. Hiltzman

It is certified that error appears in the above-identified patent and that said Letters Patent is hereby corrected as shown below:

Column 4, line 51 (claim 12), after the word "means" insert --on said face--.

Signed and Sealed this

Fifteenth Day of December, 1998

Bruce Lehman

*Attest:*

BRUCE LEHMAN

*Attesting Officer*

*Commissioner of Patents and Trademarks*